US007650941B2

(12) United States Patent
Zachry

(10) Patent No.: US 7,650,941 B2
(45) Date of Patent: Jan. 26, 2010

(54) EQUALIZING INJECTION TOOL

(75) Inventor: Jacob M. Zachry, Ventura, CA (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 11/935,258

(22) Filed: Nov. 5, 2007

(65) Prior Publication Data

US 2009/0114388 A1 May 7, 2009

(51) Int. Cl.
*E21B 21/00* (2006.01)

(52) U.S. Cl. ..... 166/312; 166/222; 166/223

(58) Field of Classification Search ..... 166/222, 166/223, 177.5, 312; 175/424
See application file for complete search history.

(56) References Cited

U.S. PATENT DOCUMENTS 2,120,988 A * 6/1938 Park ..... 166/222
2,218,130 A * 10/1940 Court ..... 15/104.12
2,745,647 A * 5/1956 Gilmore ..... 299/5
3,191,697 A * 6/1965 Haines ..... 175/81
4,335,786 A * 6/1982 Smith ..... 166/106
7,134,505 B2 * 11/2006 Fehr et al. ..... 166/387

* cited by examiner

*Primary Examiner*—Jennifer H Gay
*Assistant Examiner*—Elizabeth C Gottlieb
(74) *Attorney, Agent, or Firm*—Shawn Hunter

(57) ABSTRACT

An equalizing injection wash tool includes a plurality of interconnectable wash tool segments. Each of the segments provides a flow applicator nozzle for transmitting fluid/and or solid from the interior flowbore of the wash tool and into the surrounding formation. Each segment preferably features a plurality of nozzle pipes and nozzles which are oriented about the cross-sectional circumference of the segment in an angularly spaced orientation to provide for a flow pattern that is substantially equalized in an angular manner. In a preferred embodiment, the nozzle pipes have a length that extends into the flowbore of a neighboring wash tool segment.

14 Claims, 3 Drawing Sheets

EQUALIZING INJECTION TOOL

BACKGROUND OF THE INVENTION

1. Field of the Invention

The invention relates generally to wellbore injection tools and methods for injection of wellbore chemicals or other fluids and/or solids.

2. Description of the Related Art

Wellbore injection tools are used to inject solvents, proppants, or other materials within a formation of earth surrounding a wellbore. Typically, such injection is used to increase the potential recovery of hydrocarbons from a formation. Injection tools can also be used to inject waste fluids into the earth.

SUMMARY OF THE INVENTION

The invention provides methods and devices for selective injection of fluids and/or solids into a formation. In particular aspects, the invention provides devices and methods for flowing such injection fluids and/or solids along a formation interval of a particular length so that the flow is substantially equalized along that length.

In a currently preferred embodiment, an injection wash tool is incorporated into a downhole injection string. The wash tool includes a plurality of interconnectable wash tool segments. Each of the segments provides a flow applicator nozzle for transmitting fluid/and or solid from the interior flowbore of the wash tool and into the surrounding formation. In a preferred embodiment, the flow applicator features a plurality of nozzle pipes and nozzles, which are oriented about the cross-sectional circumference of the segment in an angularly spaced orientation to provide for a flow pattern that is substantially equalized in an angular manner. In a preferred embodiment, the nozzle pipes have a length that extends into the flowbore of a neighboring wash tool segment.

Also in a currently preferred embodiment, the injection wash tool features a plurality of wash tool segments, each of which are interconnectable with other segments, to form wash tools of different required lengths, so as to correspond to various formation interval lengths.

BRIEF DESCRIPTION OF THE DRAWINGS

The advantages and further aspects of the invention will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION OF THE PREFERRED EMBODIMENTS

Figure 1A:
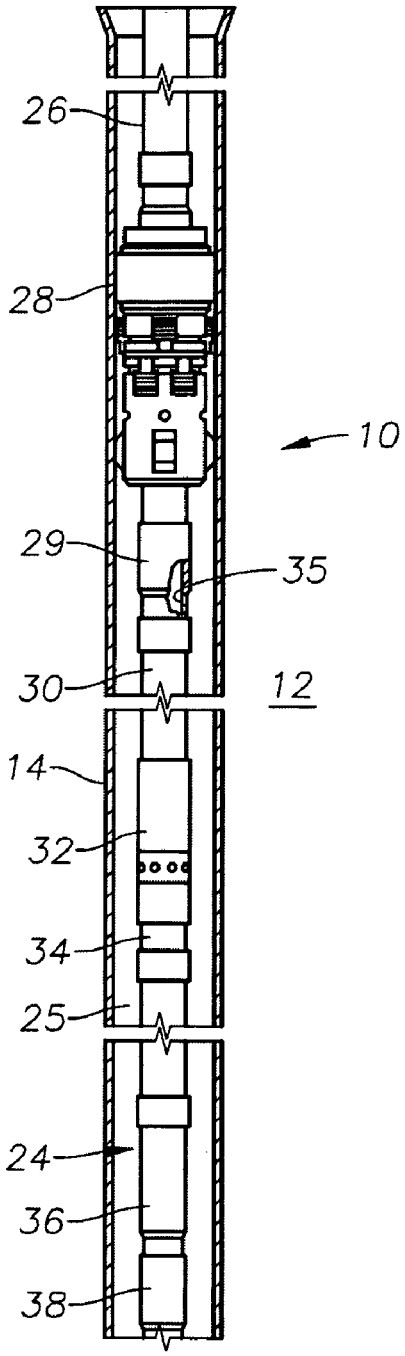
FIGS. 1A and 1B are a side, quarter cross-sectional view of an exemplary equalizing injection tool constructed in accordance with the present invention.
Figure 1B:
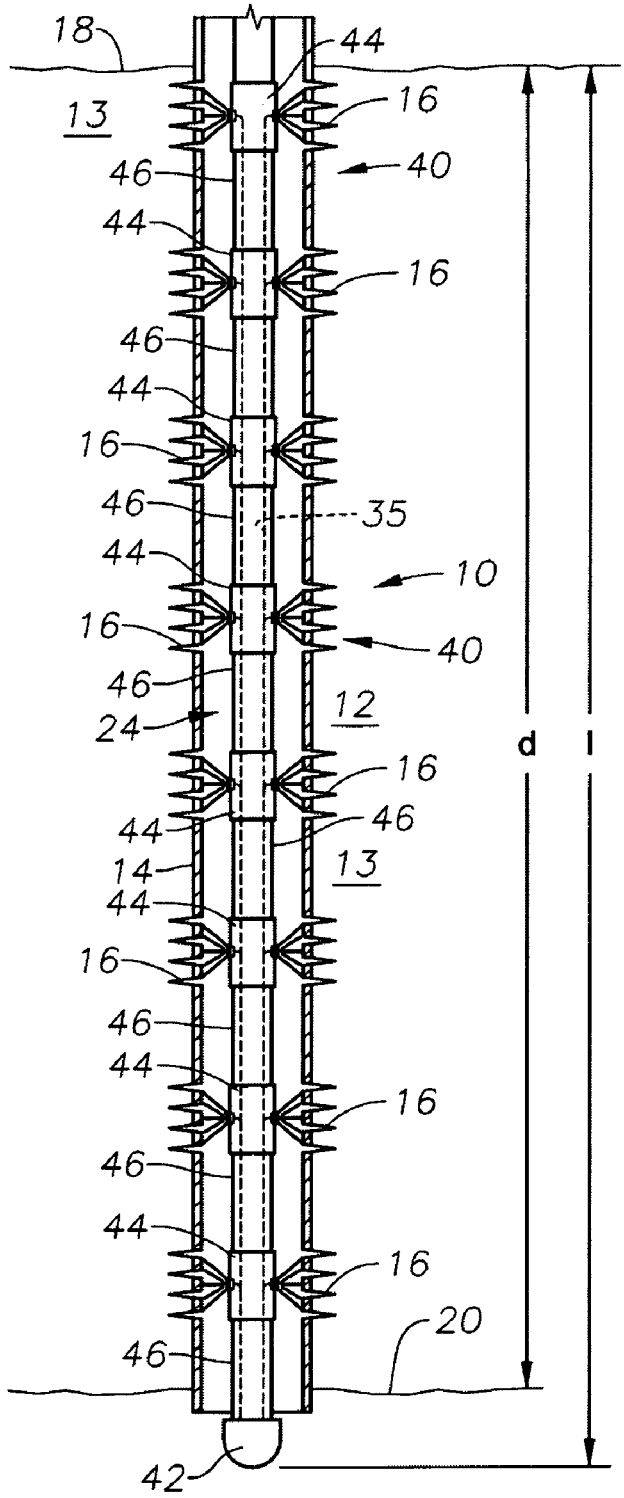

FIGS. 1A and 1B illustrate an exemplary wellbore 10 which has been drilled through the earth 12 and into a hydrocarbon-bearing formation 13. The wellbore 10 is lined with metallic casing 14. A number of perforations 16 have been formed through the casing 14 and into the formation 13. The perforations 16 are formed using any of a number of perforation tools well known in the art and permit fluid communication from the surrounding formation 13 through the casing 14 and into the wellbore 10. It is noted that the formation 13 has an upper limit 18 and a lower limit 20. The vertical distance "d", or formation interval, is the distance between the upper and lower limits 18, 20, and will vary according to the particular formation.

An exemplary equalizing production and injection tool 24, constructed in accordance with the present invention, is shown disposed within the wellbore 10. An annulus 25 is defined between the wellbore 10 and the tool 24. The tool 10 is incorporated into a string of production/injection tubing 26 which extends downwardly into the wellbore 10 from a surface wellhead (not shown) as known in the art. A service packer 28 is affixed to the lower end of the tubing 26 and is depicted in a set position in FIG. 1A. An upper cross-over tool 29 is secured below the packer 26. A section of tubing 30 interconnects the upper cross-over tool 29 to a sliding sleeve valve production nipple 32. A suitable sliding sleeve device for use as the sliding sleeve valve 32 is the CMD sliding sleeve available commercially from Baker Oil Tools of Houston, Tex. The sleeve valve 32 is used during the production phase of operations to draw in production fluids into the central flowbore 35 of the tool 10 from the surrounding wellbore 10. A section of tubing 34 interconnects the sleeve valve 32 with a seating nipple 36. The seating nipple 36 is used to seat and locate a wireline setting tool (not shown) that is used to operate the sleeve valve 32. A lower cross-over sub 38 is secured to the lower end of the seating nipple 36.

An exemplary modular wash tool, generally indicated at 40, is secured below the cross-over sub 38. At the lower end of the wash tool 40 is a bull nose closure plug 42. The wash tool 40 is generally made up of a plurality of independent wash tool segments 44, which are interconnectable to form a wash tool 40 of various lengths. In the embodiment depicted in FIGS. 1A and 1B, there are eight wash tool segments 44. The wash tool segments 44 include housings 45 which are interconnected by intermediate subs 46. As can be seen in FIGS. 1A and 1B, the made up length of the wash tool 40 approximates the vertical distance "d" of the formation interval. As a result, exterior spray nozzles associated with the wash tool 40 will be distributed in substantially regular spaced intervals along the entire length of the formation interval "d".

Figure 3:
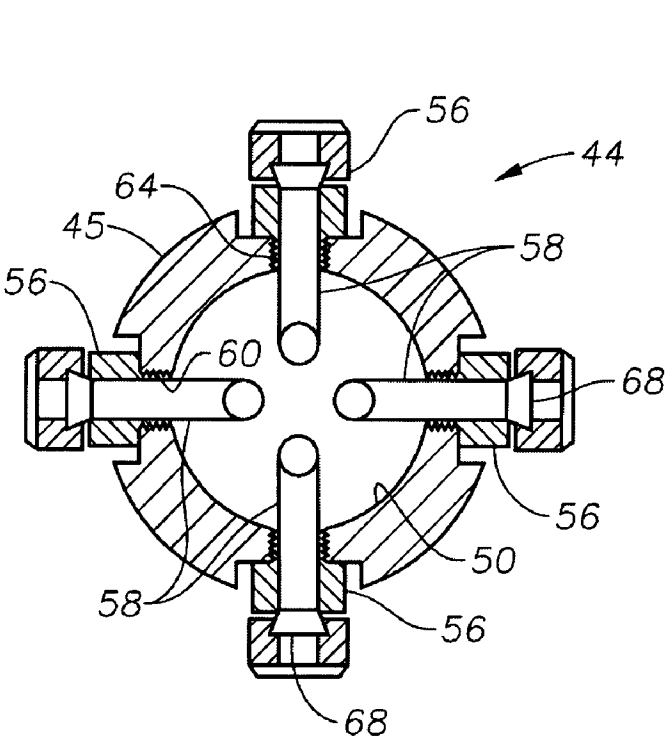
FIG. 3 is an axial cross-section of the wash tool segment of FIG. 2, taken along lines 3-3 in FIG. 2.
Figure 2:
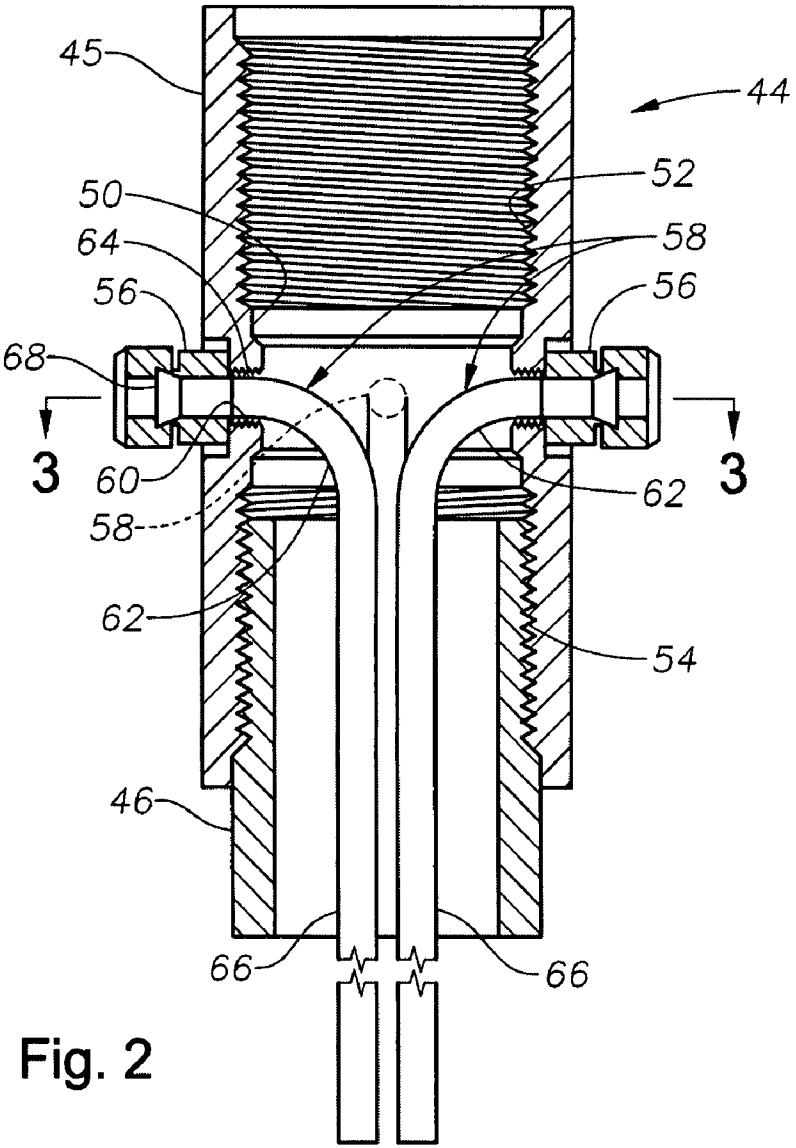
FIG. 2 is a side, cross-sectional view of an exemplary wash tool segment constructed in accordance with the present invention.

Referring now to FIGS. 2 and 3, an exemplary wash tool segment 44 is depicted in greater detail. The wash tool segment 44 includes the generally cylindrical housing 45 is which defines a central flowbore 50 with internally threaded portions 52, 54 for removable connection of the intermediate subs 46. In a currently preferred embodiment, the housing 45 is an elongated 2⅞" 6.4 ppf NU 10rd collar which is available commercially from Baker Oil Tools of Houston, Tex. However, other diameters, sizes and shapes for the housing 45 may be used, as required by the user. Exterior nut fittings 56 secure curved nozzle pipes 58 within openings 60 in the housing 45. The nozzle pipes 58 have a central curved portion 62 which separates a radial leg portion 64 and an axial leg portion 66. In a currently preferred embodiment, the nozzle pipes 58 are ⅜"×0.049" (thickness) stainless steel tubing. Each individual segment 44 also includes one intermediate sub 46 which is affixed to the housing 45. Additionally, each of the nozzle pipes 58 provides a nozzle end 68 that provides for a distributed spray pattern for fluids/solids exiting the nozzle pipe 58.

It is preferred that the nozzle pipes 58 have a length that is approximately equal to the axial length of two segments 44 plus 6 inches. This length of nozzle pipe 58 provides an optimum length for application and delivery of fluids and suspended solids as well as for equalization of flow rate along the length of the formation interval "d". In a further preferred embodiment, the axial leg portion 66 is at least 8 feet long in order to create a fluid pressure drop to increase the flow rate radially outwardly into the annulus 25.

As can be best seen in FIGS. 2 and 3, the nozzle pipes 58 are distributed in an angular spaced relation about the circumference of the housing 45. In the embodiment depicted in FIGS. 2 and 3, there are four nozzle pipes 58 and they are equally spaced at approximately 90 degrees apart from one another. This angular spaced relation permits an optimal flow pattern for fluid and/or solids exiting the nozzles 58.

Figure 5:
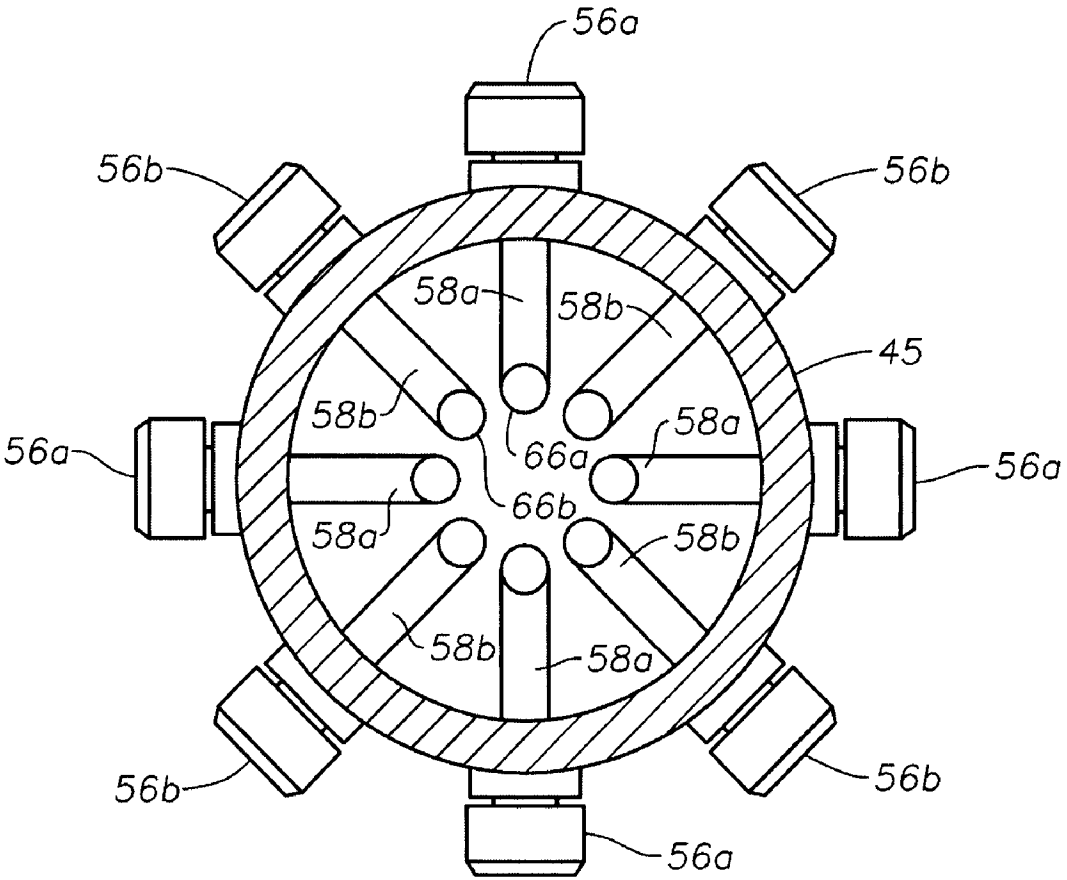
FIG. 5 is an axial cross-sectional view of the pair of wash tool segments shown in FIG. 4, taken along the lines 5-5.
Figure 4:
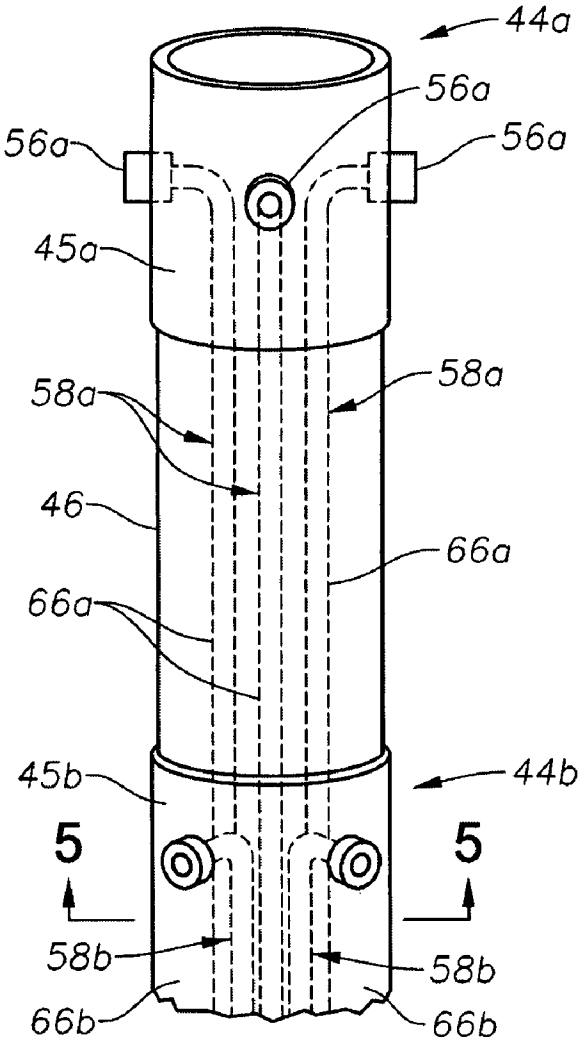
FIG. 4 is an external, isometric view of a pair of exemplary wash tool segments illustrating how the segments are fit together.

Because the axial leg portions 66 of the nozzle pipes 58 have a length that is greater than that of a wash tool segment 44, they will extend into the flowbore 50 of a neighboring wash tool segment 44. FIGS. 4 and 5 illustrate a method of accomplishing this while assuring that the nozzle pipes 58 of adjoining sections do not interfere with each other. FIG. 4 depicts an upper wash tool segment 44*a* that is joined to the upper portion of a lower wash tool segment 44*b*. As seen in FIG. 4, the upper wash tool segment housing 45*a* is rotated with respect to the lower wash tool segment housing 45*b* approximately 45 degrees. This causes the exterior fittings 56*a* and nozzle pipes 58*a* of the upper wash tool segment 44*a* to be offset approximately 45 degrees from the exterior fittings 56*b* and pipes 58*b* of the lower wash tool segment 44*b*. As a result, the axial leg portions 66*a* of the upper wash tool segment 44*a* will be disposed angularly between the nozzle pipes 58*b* of the lower wash tool segment 44*b*, thereby accommodating the longer length.

Manufacture of wash tool segments 44 is conducted by selecting nozzle pipes of a suitable length and then bending the pipes to form a generally 90 degree angle 62. The outer nuts 56 are then used to secure the nozzle pipes 58 within the housing 45 of each segment 44. A number of wash tool segments 44 are then assembled in an end-to-end fashion to form the wash tool 40. The wash tool 40 will have an axial length which approximates the vertical length "d" of the formation interval.

In operation, a wash tool 40 is assembled at the surface of the wellbore and incorporated into the injection tool 24 and production tubing string 26. The wash tool 44 is assembled to have a length "l" that approximates the formation interval "d". It is noted that the formation interval "d" may be the depth of an entire production formation 13 or some portion thereof, as determined by an operator at the surface. The wash tool 40 is is assembled from a number of separate, like wash tool segments 44, as described above. The necessary number of segments 44 are affixed to one another to approximate the formation interval "d". The string 26 is then disposed into the wellbore and the injection tool 24 lowered until the wash tool 40 is located within the desired hydrocarbon-bearing formation 13. Next, the packer device 26 is set against the casing 14 of the wellbore 10 to secure the wash tool 40 substantially within the production interval "d". Fluids containing proppants, gravel or other suspended solids are then pumped down through the central flowbore 35 and through cross-over tools 29 and 38, in a manner known in the art of wellbore injection. These fluids then enter the wash tool 40, under pressure, and specifically, the central flowbore 50 of each of the interconnected segments 44. Due to the narrowness of the nozzle pipes 58, pressure can build within the confines of the wash tool 40. Because the combined flow area of the nozzle pipes 58 is less than the flow area of the inside of the wash tool 40, a flow restriction is created and pressure is allowed to build inside of the wash tool 40. Pressurized fluid within the wash tool 40 will enter the axial leg portions 66 of each of the nozzle pipes 58 and be transmitted through the nozzle pipes 50 to the nozzle ends 68 and is sprayed radially outwardly therefrom into the annulus 25 and perforations 16. The pressurized fluid flows from the confines of the wash tool 40 into the nozzle pipes 58. As the fluid in each nozzle pipe 58 travels along a path of substantially identical length, diameter and angle as the other nozzle pipes 58, the pressure and flow rates of the fluid in each of the nozzle pipes 58 becomes substantially equal. Optimum spray patterns for the particular formation 13 are provided as a result of the tailored length "l" of the wash tool 44, the spaced angular distribution of the nozzles 68 about the circumference of each housing 45. Upon completion of the injection operation, production of fluid from the surrounding formation may be commenced through the production nipple 32, in a manner well known in the art.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention.

What is claimed is:

1. An equalizing injection tool for injection of fluid into a formation surrounding a wellbore, the tool comprising:

a wash tool formed of a plurality of interconnected, like wash tool segments, each of the wash tool segments having:

a housing defining a central flowbore:

a radially-outwardly directed nozzle retained by the housing; and a nozzle pipe extending from the nozzle axially inwardly along the flowbore;

and wherein the nozzle pipe extends axially into the flowbore of a neighboring wash tool segment housing.

2. The tool of claim 1 wherein each wash tool segment further includes an intermediate sub for connecting the housing of the wash tool segment to the housing of a neighboring wash tool segment.

3. The tool of claim 1 wherein each wash tool segment housing has a radial circumference and wherein each wash tool segment includes a plurality of nozzles and nozzle pipes, and wherein the nozzles and nozzle pipes are disposed in an angularly spaced relation about the circumference of the housing.

4. The tool of claim 3 wherein there are four nozzles and four nozzle pipes which are disposed in an angularly spaced relation of approximately 90 degree separation.

5. The tool of claim 1 wherein the housing of the wash tool segment is angularly offset from the housing of the neighboring wash tool segment to permit the nozzle pipes to extend into the flowbore of the neighboring wash tool segment.

6. A production and injection tool for use within a wellbore comprising:

a production and injection string defining a central flowbore and disposed into the wellbore to define an annulus therebetween;

a production nipple incorporated into the production and injection string for drawing of production fluid from the annulus into the central flowbore;

a wash tool for delivery of injection fluid to the annulus, the wash tool comprising a plurality of interconnected, like wash tool segments, each of the wash tool segments having:

a housing defining a central flowbore;

a radially-outwardly directed nozzle retained by the housing; and a nozzle pipe extending from the nozzle axially inwardly along the flowbore, and wherein the nozzle pipe of each wash tool segment extends axially into the flowbore of a neighboring wash tool.

7. The tool of claim 6 wherein each wash tool segment further includes an intermediate sub for connecting the housing of the wash tool segment to the housing of a neighboring wash tool segment.

8. The tool of claim 6 further comprising a packer incorporated into the production and injection string to secure the wash tool within a production interval.

9. The tool of claim 6 wherein each wash tool segment housing has a radial circumference and wherein each wash tool segment includes a plurality of nozzles and nozzle pipes, and wherein the nozzles and nozzle pipes are disposed in an angularly spaced relation about the circumference of the housing.

10. The tool of claim 9 wherein there are four nozzles and four nozzle pipes which are disposed in an angularly spaced relation of approximately 90 degree separation.

11. The tool of claim 6 wherein the housing of the wash tool segment is angularly off set from the housing of the neighboring was tool segment to permit the nozzle pipes to extend into the flowbore of the neighboring wash tool segment.

12. A method of injecting fluid into a wellbore having a production formation, the method comprising the steps of:

constructing a wash tool having a length which approximates the length of a formation interval of interest, the wash tool having a plurality of interconnected, like wash tool segments, each of the wash tool segments having:

a housing defining a central flowbore;

a radially-outwardly directed nozzle retained by the housing;

a nozzle pipe extending from the nozzle axially inwardly along the flowbore;

disposing the wash tool into a wellbore having a production formation;

aligning the wash tool within the formation interval; and injecting fluid through the wash tool and into the formation.

13. The method of claim 12 further comprising the step of setting a packer within the wellbore prior to injecting fluid through the wash tool.

14. The method of claim 12 wherein the step of constructing a wash tool further comprises securing the housing of each wash tool segment with a housing of another wash tool segment with an interconnecting sub.

* * * * *